US009147541B2

(12) United States Patent
Feil et al.

(10) Patent No.: US 9,147,541 B2
(45) Date of Patent: Sep. 29, 2015

(54) CIRCUIT BREAKER COMPRISING VENTILATION CHANNELS FOR EFFICIENT HEAT DISSIPATION

(75) Inventors: Wolfgang Feil, Schwandorf (DE); Rainer Kreutzer, Weiden (DE); Alexander Spies, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 13 days.

(21) Appl. No.: 14/117,454

(22) PCT Filed: Sep. 3, 2012

(86) PCT No.: PCT/EP2012/067125

§ 371 (c)(1),
(2), (4) Date: Nov. 13, 2013

(87) PCT Pub. No.: WO2013/041358

PCT Pub. Date: Mar. 28, 2013

(65) Prior Publication Data

US 2014/0332502 A1 Nov. 13, 2014

(30) Foreign Application Priority Data

Sep. 21, 2011 (EP) ..... 11182094

(51) Int. Cl.
*H01H 33/53* (2006.01)
*H01H 9/34* (2006.01)
(Continued)

(52) U.S. Cl.
CPC ..... *H01H 33/53* (2013.01); *H01H 9/342* (2013.01); *H01H 9/52* (2013.01); *H01H 71/025* (2013.01); *H01H 9/047* (2013.01); *H01H 2009/348* (2013.01); *H01H 2223/002* (2013.01)

(58) Field of Classification Search
CPC ..... H01H 9/342; H01H 33/04; H01H 9/345
USPC ..... 335/16–18, 35
See application file for complete search history.

(56) References Cited

U.S. PATENT DOCUMENTS 2,871,322 A 1/1959 Immel
3,943,473 A * 3/1976 Khalid ..... 335/16
(Continued)

FOREIGN PATENT DOCUMENTS

CN 1494727 A 7/2003
CN 1744252 A 3/2006
(Continued)

OTHER PUBLICATIONS

International Search Report PCT/ISA/210 for PCT/EP2012/067125 dated Dec. 7, 2012.
(Continued)

*Primary Examiner* — Truc Nguyen
(74) *Attorney, Agent, or Firm* — Harness, Dickey & Pierce, P.L.C.

(57) ABSTRACT

A circuit breaker includes a housing equipped with a first switchgear region, in which a quenching chamber device and a sliding contact device having movable contacts are located, the contacts lying opposite fixed contacts, and equipped with a second switchgear region, in which a current release assembly consisting of a short-circuit release and an overload release are located. In an embodiment, a continuous ventilation channel is formed within opposing housing walls along the fixed contacts, the channel acting as a first convective air-flow through the circuit breaker in order to dissipate the heat.

20 Claims, 4 Drawing Sheets

(51) Int. Cl.

| | |
|---|---|
| ***H01H 9/52*** | (2006.01) |
| ***H01H 71/02*** | (2006.01) |
| *H01H 9/04* | (2006.01) |

(56) References Cited

U.S. PATENT DOCUMENTS

| | | | | |
|---|---|---|---|---|
| 3,953,812 | A * | 4/1976 | Heft et al. | 335/23 |
| 4,417,222 | A * | 11/1983 | Schmitt et al. | 335/6 |
| 4,430,631 | A * | 2/1984 | Forsell et al. | 335/16 |
| 4,650,937 | A * | 3/1987 | Belbel et al. | 200/434 |
| 5,245,302 | A * | 9/1993 | Brune et al. | 335/35 |
| 5,483,211 | A * | 1/1996 | Carrodus et al. | 335/18 |
| 5,608,198 | A * | 3/1997 | Clark et al. | 218/147 |
| 7,009,132 | B1 | 3/2006 | Shea et al. | |
| 2003/0048586 | A1 | 3/2003 | Faber | |
| 2015/0008106 | A1 | 1/2015 | Spies | |

FOREIGN PATENT DOCUMENTS

| | | | |
|---|---|---|---|
| DE | 19935661 | A1 | 2/2001 |
| DE | 20030048586 | A1 | 4/2003 |
| EP | 1073084 | A2 | 2/2001 |
| EP | 1073084 | B1 | 8/2003 |
| EP | 1471553 | A1 | 10/2004 |
| EP | 1632972 | A1 | 3/2006 |
| EP | 2573784 | | 3/2013 |
| KR | 100552413 | B1 | 2/2006 |
| WO | WO03065396 | A1 | 7/2003 |

OTHER PUBLICATIONS

Written Opinion PCT/ISA/237 for PCT/EP2012/067125 dated Dec. 7, 2012.

Korean Office Action dated Jun. 19, 2015.

Chinese Office Action and English translation thereof dated Jun. 3, 2015.

* cited by examiner

CIRCUIT BREAKER COMPRISING VENTILATION CHANNELS FOR EFFICIENT HEAT DISSIPATION

PRIORITY STATEMENT

This application is the national phase under 35 U.S.C. §371 of PCT International Application No. PCT/EP2012/067125 which has an International filing date of Sep. 3, 2012, which designated the United States of America and which claims priority to European patent application number EP11182094.0 filed Sep. 21, 2011, the entire contents of each of which are hereby incorporated herein by reference.

FIELD

At least one embodiment of the invention generally relates to a circuit breaker comprising a housing, in which a first switchgear region, in which a quenching chamber apparatus and a contact slide apparatus with moving contact pieces which are positioned opposite fixed contact pieces are arranged, and a second switchgear region, in which a current release group comprising a short-circuit release and an overload release is arranged, are arranged.

BACKGROUND

Circuit breakers, in particular low-voltage circuit breakers, are electromagnetic automatic switches in the event of a short circuit. Their manner of operation corresponds, in principle, to the manner of operation of miniature circuit breakers. They are usually equipped with a thermal release and a magnetic release and therefore have the same design elements as miniature circuit breakers. However, they are designed for relatively high rated currents, and the releases of circuit breakers, in contrast to miniature circuit breakers, can furthermore be adjusted partially separately. The switches are also used as motor protection switches in the low-voltage range.

The task of the circuit breaker is to protect downstream installations and, in particular, three-phase motors against damage due to overloading or short-circuiting. In this case, the aim is for the circuit breaker to interrupt these currents in conjunction with the devices of the mains contactor. If gas is present between the two poles, it is ionized by the flashover when there is a correspondingly high voltage difference between the poles, and a self-maintained gas discharge, which is also called an arc, is formed. This plasma not only continues to conduct current but also reduces the service life of the component and may even destroy the switch given heavy currents. In contrast to disconnection devices, circuit breakers are designed such that the arc which is produced when the switching contacts are opened is quenched rapidly and without damaging the switch and, as a result, the current flow is interrupted.

Circuit breakers are developed in various installation sizes. In this case, an installation size is made up of device variants with a series of rated currents which expediently build on one another, wherein the power loss is approximately proportional to the square of the rated current. The device variant with the highest rated current at a given installation size is determined by, even for this current, the power loss conversion given a corresponding housing volume being maintained for the requirements of the switching device over its service life without disadvantageous consequences. If even higher rated currents are desired, a larger design is developed. However, from a customer's point of view, it is desirable to drive the maximum rated current within an installation size even higher. In order to achieve this, measures can be taken in order to make the dissipation of heat from the housing volume technically more efficient.

In principle, there are two options for dealing with high temperatures within a protective housing on account of unavoidable electrical power loss. From amongst said options, one option makes provision for all materials to be optimized to such an extent that they meet their functional requirements even at a high temperature level. However, this is a very costly solution.

The other option is to force the generated heat to be dissipated from the housing by technical measures. For electronic products, active cooling measures by way of housing fans, a heat pipe arrangement or even coolant circuits are known from the prior art. In order to be able to also dissipate large quantities of locally generated heat in this way, the quantities of heat are distributed over large areas by use of heat sinks.

Heat sinks of this kind are unsuitable for electromechanical switchgears. In this case, in addition to the connection lines, the heat is mainly dissipated via the freely accessible surfaces of the device, essentially the top side, feed side and device output side. In practice, this often leads to a high device temperature level and to disadvantageous, relatively concentrated heat pockets on account of the long heat path.

SUMMARY

At least one embodiment of the present invention is directed to a circuit breaker which allows efficient heat dissipation without additional heat sinks.

Advantageous embodiments and developments which can be used individually or in combination with one another are the subject matter of the dependent claims.

According to at least one embodiment of the invention, a circuit breaker includes a first switchgear region, in which a quenching chamber apparatus and a contact slide apparatus with moving contact pieces which are positioned opposite fixed contact pieces are arranged, and a second switchgear region, in which a current release group comprising a short-circuit release and an overload release is arranged, are arranged. At least one embodiment of the invention is distinguished in that a continuous ventilation channel is formed within opposite housing walls along the fixed contact pieces as a first convective air flow through the circuit breaker for heat dissipation.

According to at least one embodiment of the invention, the heat is additionally dissipated to the surfaces of the device via a continuous ventilation channel which runs from the feed side, through the device, to the output side and has a large cross section. In the preferred installation position, that is to say when mounted on a vertical wall, feeding is performed at the top and output is performed at the bottom, air which flows into provided openings from below can absorb lost heat directly from some of the main power loss generators, that is to say from contact transition points and current paths, and transport it in the direction of the feed side and there emit it out into the air.

According to at least one embodiment of the invention, a first convective air flow is provided along the fixed contact pieces. The convective air flow along the fixed contact pieces is ensured by structural reshaping of the fixed contact pieces, the contact slide apparatus and the covers on the fixed contact pieces. The principle here is to obtain an appreciable continuous flow cross section. All the elements which are sealed off from the outside are removed or reshaped. At the same time, the open cross section between the continuous flow cross section and the switching chamber is kept as small as possible by corresponding structural reshaping.

The fixed contact pieces are structurally of U-shape design and have two limbs and a transition region which connects the two limbs. In this case, the transition region is formed in such a way that two horned contours are situated parallel and opposite to one another and are spaced apart by a recess. In this case, the horned contours of the fixed contact pieces engage in mating contours of the switch inner housing and therefore contribute to stabilizing the entire circuit breaker in the event of a short circuit. A limb extension in the form of a lug is formed in the recess of the transition region of the fixed contact piece, said lug increasing the size of the contact area for the contact which is arranged at the bottom of the limb. In particular, this limb extension of the fixed contact piece leads to the open cross section between the continuous ventilation channel and the switching chamber being kept as low as possible.

In addition, the contact slide also has a recess which is in the form of a through-hole or an aperture or which is simply open at the top in the manner of a U, the recess being arranged level with the recess in the fixed contact pieces and thereby forming a complete continuous ventilation channel across the fixed contact pieces and the contact slide, said continuous ventilation channel being completed across covers on the fixed contact pieces and finally across openings in the housing. Overall, this provides a first convective air flow along the fixed contact pieces through recesses on the contact slide apparatus, on the fixed contact pieces and on the covers which are arranged on the fixed contact pieces, said recesses together forming a continuous ventilation channel which allows heat to be dissipated through openings in the housing.

According to at least one embodiment of the invention, a second convective air flow is preferably formed in the L-side connection region which branches off from the first convective air flow along the fixed contact pieces into the second switchgear region and allows heat to be dissipated via a terminal connection and openings in the housing. In this case, heat is also absorbed by way of the terminal as it flows past.

In addition, a third convective air flow is preferably formed in the T-side connection region which is formed at the terminal connection by means of a channel and allows heat to be dissipated via openings in the housing. This convective air flow in the T-side connection region flows into the switch and through a channel past the hot terminal. The air flow absorbs heat in the process and then leaves the switch through openings in the housing.

In a particularly advantageous embodiment, provision is made for elements which receive dirt to be arranged in the continuous ventilation channel, the elements being formed in such a way that they protect the circuit breaker against soiling, without preventing air from flowing through. This element which receives dirt is preferably in the form of a grating or in the form of areas arranged one behind the other and appear to be closed when viewed in projection, and therefore prevent dirt from falling in but allow air to circulate.

An embodiment of the present invention is distinguished in that a continuous ventilation channel is formed within opposite housing walls along the fixed contact pieces as a first convective air flow through the circuit breaker for heat dissipation. Two further convective air flows are preferably provided in the L-side connection region and also in the T-side connection region. Relatively large heat losses can be dissipated through these convective air flows according to an embodiment of the invention, so that relatively high rated current densities of the circuit breakers are allowed with the same installation volume. By virtue of the design according to an embodiment of the invention, heat-emitting areas or openings are prevented from being covered given a design of circuit breakers which are arranged next to one another. The heat derivation concept presented here leads to a considerable reduction in the temperature level given the same device installation size.

BRIEF DESCRIPTION OF THE DRAWINGS

Further advantages and embodiments of the invention will be explained below with reference to example embodiments and with reference to the drawing.

In the drawing.

DETAILED DESCRIPTION OF THE EXAMPLE EMBODIMENTS

Figure 1:
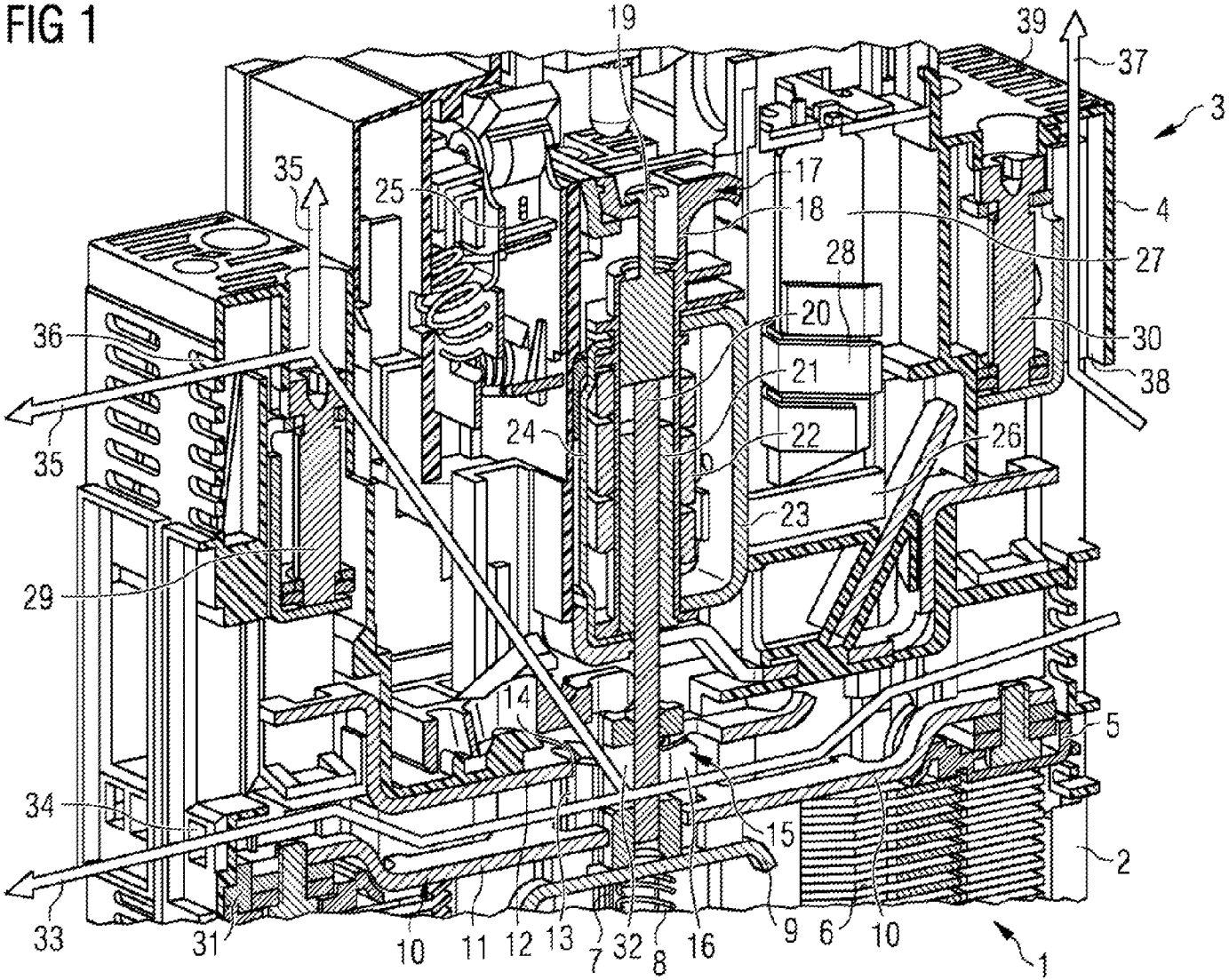
FIG. 1 schematically shows a perspective sectional illustration of a design of a circuit breaker according to an embodiment of the invention with three convective individual flows for heat dissipation.

FIG. 1 shows the design of a circuit breaker according to an embodiment of the invention having a preferably two-part housing in which a first switchgear region 1 is arranged in a housing lower part 2 and a second switchgear region 3 is arranged in a housing upper part 4. A quenching chamber apparatus 5 with quenching plates 6 which are arranged one above the other is arranged in the first switchgear region 1, and a contact slide apparatus 7 having a moving contact piece 9 which is positioned on a spring 8 is arranged centrally between the two quenching plate stacks. The moving contact piece 9 is arranged opposite fixed contact pieces 10. The fixed contact pieces 10 are preferably of U-shaped design and have two limbs 11, 12 which are connected to one another by a transition region 13. The transition region 13 of the fixed contact pieces 10 is preferably in the form of horned contours 14 which are preferably of web-like design and are spaced apart from one another by a recess 15. The horned contours 14 engage in mating contours 16 of the housing inner wall of the circuit breaker, so that the housing is stabilized in the event of a short circuit.

A short-circuit release 17 is arranged above the contact slide apparatus 7 in the second switchgear region 3. The short-circuit release 17 has a support part 18, preferably composed of plastic, in which an armature 19 with a tappet 20, arranged within a pole 21 and projects into the contact slide apparatus 7, is located. A coil 22 is wound around the support part 18. The coil 22 is surrounded by a yoke 23 and a magnetic plate 24. A latch 25 is arranged above the short-circuit release 17.

An overload release 26, including a bimetallic strip 27 around which a heating conductor 28 is wound, is located next to the short-circuit release 17. Terminal connections 29, 30 are located laterally above each of the quenching plate stacks in the housing upper part 4.

The circuit breaker according to an embodiment of the invention is now distinguished in that the convective air flow through the circuit breaker for heat dissipation is composed of preferably three individual flows. According to an embodiment of the invention, a first convective air flow is provided along the fixed contact pieces 10. The convective air flow along the fixed contact pieces 10 is achieved by structural reshaping of the fixed contact pieces 10, the contact slide apparatus 7 and a cover 31 which is positioned on the fixed contact pieces 10. In this case, the principle is to obtain an appreciable continuous flow cross section. All the elements which are sealed off from the outside are removed or reshaped. At the same time, the open cross section between the continuous flow cross section and the switching chamber is kept as small as possible by corresponding structural reshaping.

The fixed contact pieces 10 are structurally of U-shaped design and have the two limbs 11, 12 and the transition region 13 which connects the two limbs 11, 12. In this case, the transition region 13 has the horned contours 14 which are arranged parallel and opposite the recess 15.

The contact slide apparatus 7 also has a recess 32 which is in the form of a through-hole which is arranged level with the recess 15 in the fixed contact pieces 10, and thereby forms a complete continuous ventilation channel 33 across the fixed contact pieces 10 and the contact slide apparatus 7, the continuous ventilation channel being completed across the covers 31 on the fixed contact pieces 10 and finally across openings 34 in the housing.

Overall, this provides a first convective air flow along the fixed contact pieces 10 through recesses 15, 32 on the contact slide apparatus, on the fixed contact pieces and on the covers 31 which are arranged on the fixed contact pieces, said recesses together forming a continuous ventilation channel 33 which allows heat to be dissipated through the opening 34 in the housing.

According to an embodiment of the invention, a second convective air flow 35 is formed in the L-side connection region which branches off from the first convective air flow along the fixed contact pieces 10 into the second switchgear region 3 and allows heat to be dissipated via a terminal connection 29 and openings 36 in the housing. In this case, heat is also absorbed by means of the terminal as it flows past.

In addition, a third convective air flow 37 is formed in the T-side connection region which is formed at the terminal connection 30 by means of a channel 38 and allows heat to be dissipated via openings 39 in the housing. This convective air flow in the T-side connection region flows into the switch and through a channel past the hot terminal. Said air flow absorbs heat in the process and then leaves the switch through openings 39 in the housing.

Figure 2:
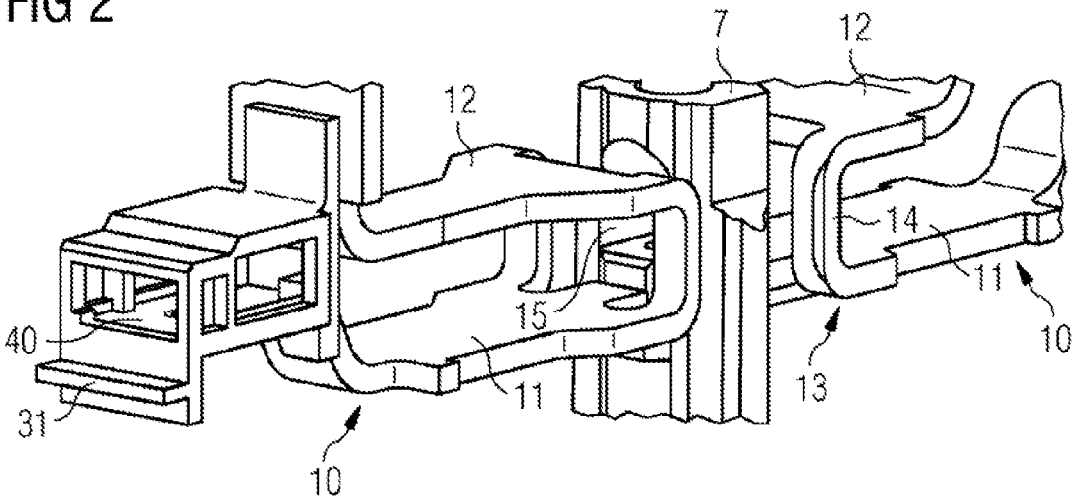
FIG. 2 schematically shows a perspective illustration of an arrangement according to an embodiment of the invention comprising a contact slide apparatus, fixed contact pieces and a cover.

FIG. 2 shows an arrangement according to an embodiment of the invention comprising the contact slide apparatus 7, the fixed contact pieces 10 and the cover 31 on the fixed contact pieces 10, which components allow the first convective air flow. In this case, the fixed contact pieces 10 are of U-shaped design and have the two limbs 11, 12 which are connected to one another by way of a transition region 13. In this case, the transition region 13 of the fixed contact pieces 10 is formed with horned contours 14 which are preferably of web-like design and are spaced apart from one another by the recess 15. The horned contours 14 engage in mating contours 16 of the housing inner wall of the circuit breaker when they are mounted in the circuit breaker, so that the housing is stabilized in the event of a short circuit.

The cover 31 on the fixed contact pieces 10 is also provided with recesses 40, so that complete continuous ventilation is possible. In addition, the recess 32 on the contact slide apparatus 7 is level with the recess 15 on the fixed contact pieces 10 in FIG. 2.

Figure 3:
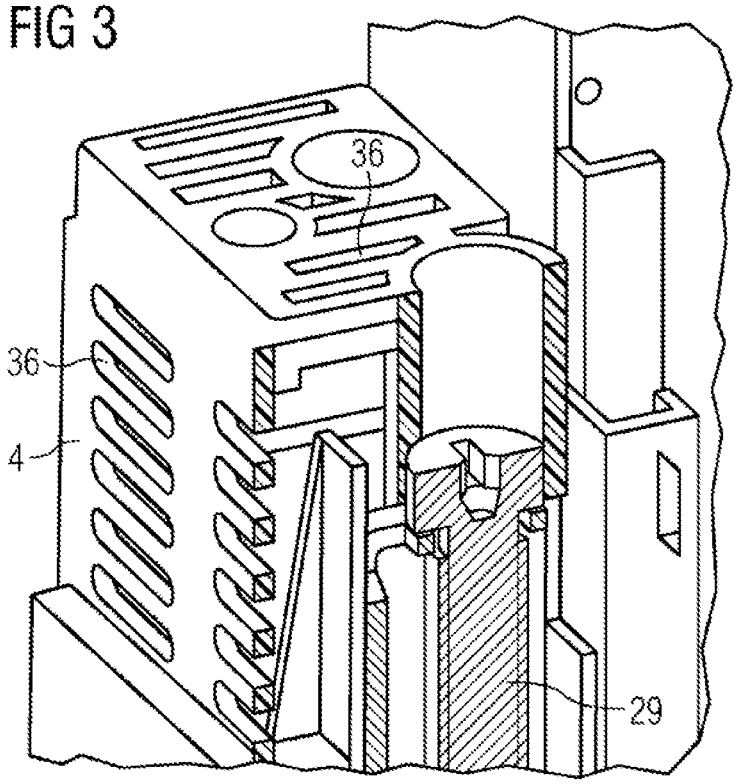
FIG. 3 schematically shows a perspective illustration of a subregion of an L-side connection region with a terminal.

FIG. 3 shows a subregion of an L-side connection region of a circuit breaker with a terminal. The convective air flow 35 in the L-side connection region branches off from the flow along the fixed contact pieces 10. It passes the terminal by means of an open cross section in the switch. It then leaves the switch via openings 36 in the housing upper part 4 and housing lower part and in the process flows past the terminal. Heat is once again absorbed by means of the terminal as the air flow flows past.

Figure 4:
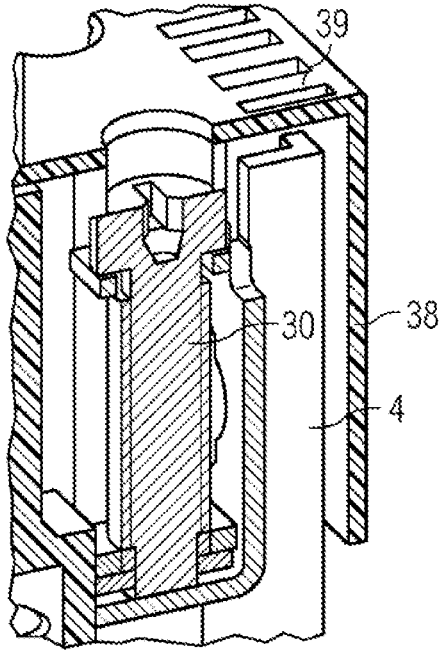
FIG. 4 schematically shows a perspective illustration of a subregion of a T-side connection region with a terminal.

FIG. 4 shows a subregion of a T-side connection region with a terminal. The convective air flow 37 in the T-side connection region flows into the switch and then through the channel 38 past the hot terminal. In the process, it absorbs heat and then leaves the switch through openings 39 in the housing wall.

Figure 5:
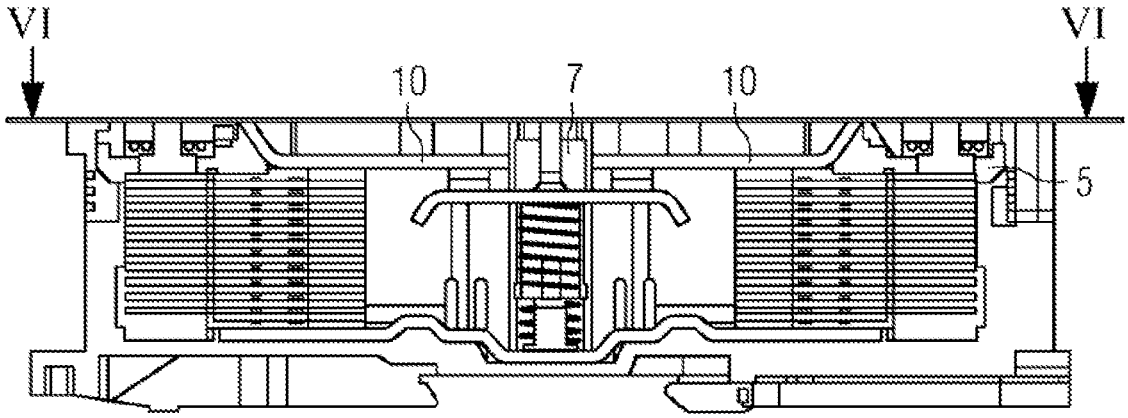
FIG. 5 schematically shows a sectional illustration of the quenching chamber apparatus of the circuit breaker with a contact slide apparatus and fixed contact pieces.
Figure 6:
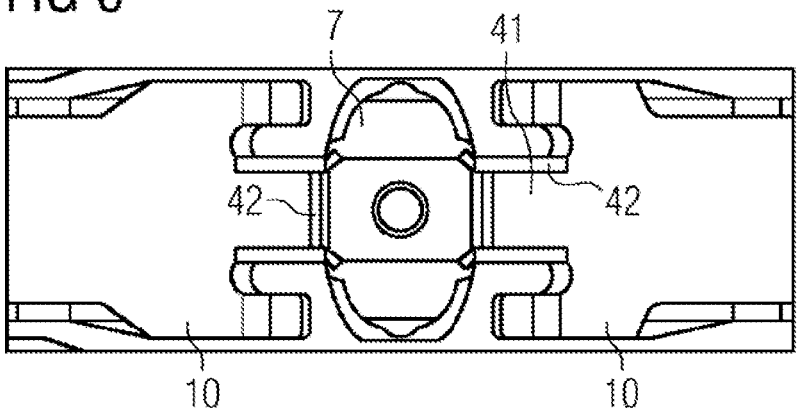
FIG. 6 schematically shows a plan view of the arrangement of fixed contact pieces and a contact slide apparatus.

FIG. 5 shows the quenching chamber apparatus 5 with the contact slide apparatus 7 and fixed contact pieces 10. In particular, the design of the fixed contact pieces 10 allows sealing between the continuous ventilation channel 33 and the switching chamber. To this end, FIG. 6 shows that the limbs 11 form a limb extension in the form of a lug 41 which reaches the contact slide apparatus 7. The bearing area for the contacts below the limb is firstly increased in size by said lug 41, and secondly the open cross section 42 to the switching chamber is minimized as a result, so that sealing between the continuous ventilation channel 33 and the switching chamber is possible.

An embodiment of the present invention is distinguished in that a continuous ventilation channel is formed within opposite housing walls along the fixed contact pieces as a first convective air flow through the circuit breaker for heat dissipation. Two further convective air flows are preferably provided in the L-side connection region and also in the T-side connection region. Relatively large heat losses can be dissipated by these convective air flows according to an embodiment of the invention, so that relatively high rated current densities of the circuit breakers are allowed with the same installation volume. By virtue of the design according to the invention, heat-emitting areas or openings are prevented from being covered given a design of circuit breakers which are arranged next to one another. The heat derivation concept presented here leads to a considerable reduction in the temperature level given the same device installation size.

The invention claimed is:

1. A circuit breaker, comprising:

a housing, in which a first switchgear region, a quenching chamber apparatus and a contact slide apparatus with moving contact pieces, positioned opposite fixed contact pieces, are arranged; and a second switchgear region, in which a current release group including a short-circuit release and an overload release is arranged, wherein a continuous ventilation channel is formed within opposite walls of the housing along the fixed contact pieces as a first convective air flow through the circuit breaker for heat, and wherein the first convective air flow is formed along the fixed contact pieces through recesses on the contact slide, on the fixed contact pieces and on the covers arranged on the fixed contact pieces, said recesses together forming the continuous ventilation channel which allows heat to be dissipated through openings in the housing.

2. The circuit breaker of claim 1, wherein the fixed contact pieces include horned contours which engage in mating contours in the switching housing.

3. The circuit breaker of claim 1, wherein lugs are formed on the fixed contact pieces.

4. The circuit breaker of claim 1, wherein a second convective air flow is formed in the L-side connection region which branches off from the first convective air flow along the fixed contact pieces into the second switchgear region and allows heat to be dissipated via a terminal connection and openings in the housing.

5. The circuit breaker of claim 1, wherein a third convective air flow is formed in a T-side connection region formed at the terminal connection via a channel and allows heat to be dissipated via openings in the housing.

6. The circuit breaker of claim 1, wherein elements which receive dirt are arranged in the continuous ventilation channel and are formed to protect the continuous ventilation channel against contamination, without preventing air from flowing through.

7. The circuit breaker of claim 6, wherein the element which receives dirt is in the form of a grating or in the form of closed contours which are arranged one behind the other when viewed in projection.

8. The circuit breaker of claim 2, wherein lugs are formed on the fixed contact pieces.

9. The circuit breaker of claim 2, wherein the first convective air flow is formed along the fixed contact pieces through recesses on the contact slide, on the fixed contact pieces and on the covers arranged on the fixed contact pieces, said recesses together forming the continuous ventilation channel which allows heat to be dissipated through openings in the housing.

10. The circuit breaker of claim 2, wherein a second convective air flow is formed in the L-side connection region which branches off from the first convective air flow along the fixed contact pieces into the second switchgear region and allows heat to be dissipated via a terminal connection and openings in the housing.

11. The circuit breaker of claim 2, wherein a third convective air flow is formed in a T-side connection region formed at the terminal connection via a channel and allows heat to be dissipated via openings in the housing.

12. The circuit breaker of claim 2, wherein elements which receive dirt are arranged in the continuous ventilation channel and are formed to protect the continuous ventilation channel against contamination, without preventing air from flowing through.

13. The circuit breaker of claim 4, wherein a third convective air flow is formed in a T-side connection region formed at the terminal connection via a channel and allows heat to be dissipated via openings in the housing.

14. A circuit breaker, comprising:

a housing, in which a first switchgear region, a quenching chamber apparatus and a contact slide apparatus with moving contact pieces, positioned opposite fixed contact pieces, are arranged; and a second switchgear region, in which a current release group including a short-circuit release and an overload release is arranged, wherein a continuous ventilation channel is formed within opposite walls of the housing along the fixed contact pieces as a first convective air flow through the circuit breaker for heat, and wherein a second convective air flow is formed in the L-side connection region which branches off from the first convective air flow along the fixed contact pieces into the second switchgear region and allows heat to be dissipated via a terminal connection and openings in the housing.

15. The circuit breaker of claim 14, wherein a third convective air flow is formed in a T-side connection region formed at the terminal connection via a channel and allows heat to be dissipated via openings in the housing.

16. The circuit breaker of claim 14, wherein elements which receive dirt are arranged in the continuous ventilation channel and are formed to protect the continuous ventilation channel against contamination, without preventing air from flowing through.

17. The circuit breaker of claim 16, wherein the element which receives dirt is in the form of a grating or in the form of closed contours which are arranged one behind the other when viewed in projection.

18. A circuit breaker, comprising:

a housing, in which a first switchgear region, a quenching chamber apparatus and a contact slide apparatus with moving contact pieces, positioned opposite fixed contact pieces, are arranged; and a second switchgear region, in which a current release group including a short-circuit release and an overload release is arranged, wherein a continuous ventilation channel is formed within opposite walls of the housing along the fixed contact pieces as a first convective air flow through the circuit breaker for heat, and wherein the fixed contact pieces include horned contours which engage in mating contours in the switching housing.

19. The circuit breaker of claim 18, wherein a second convective air flow is formed in the L-side connection region which branches off from the first convective air flow along the fixed contact pieces into the second switchgear region and allows heat to be dissipated via a terminal connection and openings in the housing.

20. The circuit breaker of claim 19, wherein a third convective air flow is formed in a T-side connection region formed at the terminal connection via a channel and allows heat to be dissipated via openings in the housing.

* * * * *